US008192825B2

(12) United States Patent
Shilale et al.

(10) Patent No.: US 8,192,825 B2
(45) Date of Patent: Jun. 5, 2012

(54) LOW MELT PLASTIC FASTENER

(75) Inventors: Thomas Shilale, Douglas, MA (US); Charles J. Burout, III, Bedford, NH (US)

(73) Assignee: Avery Dennison Corporation, Pasadena, CA (US)

( * ) Notice: Subject to any disclaimer, the term of this patent is extended or adjusted under 35 U.S.C. 154(b) by 825 days.

(21) Appl. No.: 12/287,895

(22) Filed: Oct. 14, 2008

(65) Prior Publication Data

US 2009/0114558 A1 May 7, 2009

Related U.S. Application Data

(60) Provisional application No. 60/998,870, filed on Oct. 12, 2007.

(51) Int. Cl.
*B65D 85/24* (2006.01)
*G09F 3/12* (2006.01)

(52) U.S. Cl. ..... 428/99; 24/298; 24/300; 206/338; 206/340; 206/343; 206/345; 206/346; 428/223; 428/299.1

(58) Field of Classification Search ..... 428/99, 428/299.1, 223; 24/298, 300; 206/338, 340, 206/343, 345, 346
See application file for complete search history.

(56) References Cited

U.S. PATENT DOCUMENTS

| | | | | |
|---|---|---|---|---|
| 3,103,666 | A | 9/1963 | Bone | |
| 3,945,096 | A | 3/1976 | Miranker | |
| 4,039,078 | A | 8/1977 | Bone | |
| 4,462,784 | A | 7/1984 | Russell | |
| 4,759,106 | A | 7/1988 | McPeak et al. | |
| 2003/0227959 | A1 | 12/2003 | Balian et al. | |
| 2004/0031838 | A1 * | 2/2004 | Cooper et al. | 227/67 |
| 2008/0057285 | A1 * | 3/2008 | Polk | 428/299.1 |

OTHER PUBLICATIONS

Data Sheet for Pearlbond 122 linear thermoplastic polyurethane, (Merquinsa, Barcelona, Spain), published Apr. 2006.
Data Sheet for Pearlcoat 125K thermoplastic polyurethane elastomer, (Merquinsa, Barcelona, Spain), published Jun. 2008.
Data Sheet for Pearlcoat 126K thermoplastic polyurethane elastomer, (Merquinsa, Barcelona, Spain), published Jun. 2008.
Data Sheet for Lustran San 31 resin, (INEOS ABS (USA), Corporation, Addyston, Ohio), published May 28, 2008.
Product Information for Texin 255 thermoplastic polyurethane, (Bayer MaterialScience LLC, Pittsburgh, PA), published Oct. 2002.

* cited by examiner

*Primary Examiner* — Brent Ohern
(74) *Attorney, Agent, or Firm* — Kriegsman & Kriegsman

(57) ABSTRACT

A low-melt plastic fastener. According to one embodiment, the low-melt plastic fastener is shaped to include a flexible filament having a first cross-bar at a first end, and a second cross-bar at a second end. The filament, the first cross-bar, and the second cross-bar may be formed from the same material and may be molded as a unitary structure. Preferably, the fastener is molded as part of a length of continuously connected ladder stock. The plastic fastener is preferably made from a formulation consisting of about 60-99%, by weight, of a low-melt polyurethane and 1-40%, by weight, of a styrene acrylonitrile. The formulation is selected so that the filament melts when heated for about 10 minutes at 130-180° C.

22 Claims, 1 Drawing Sheet

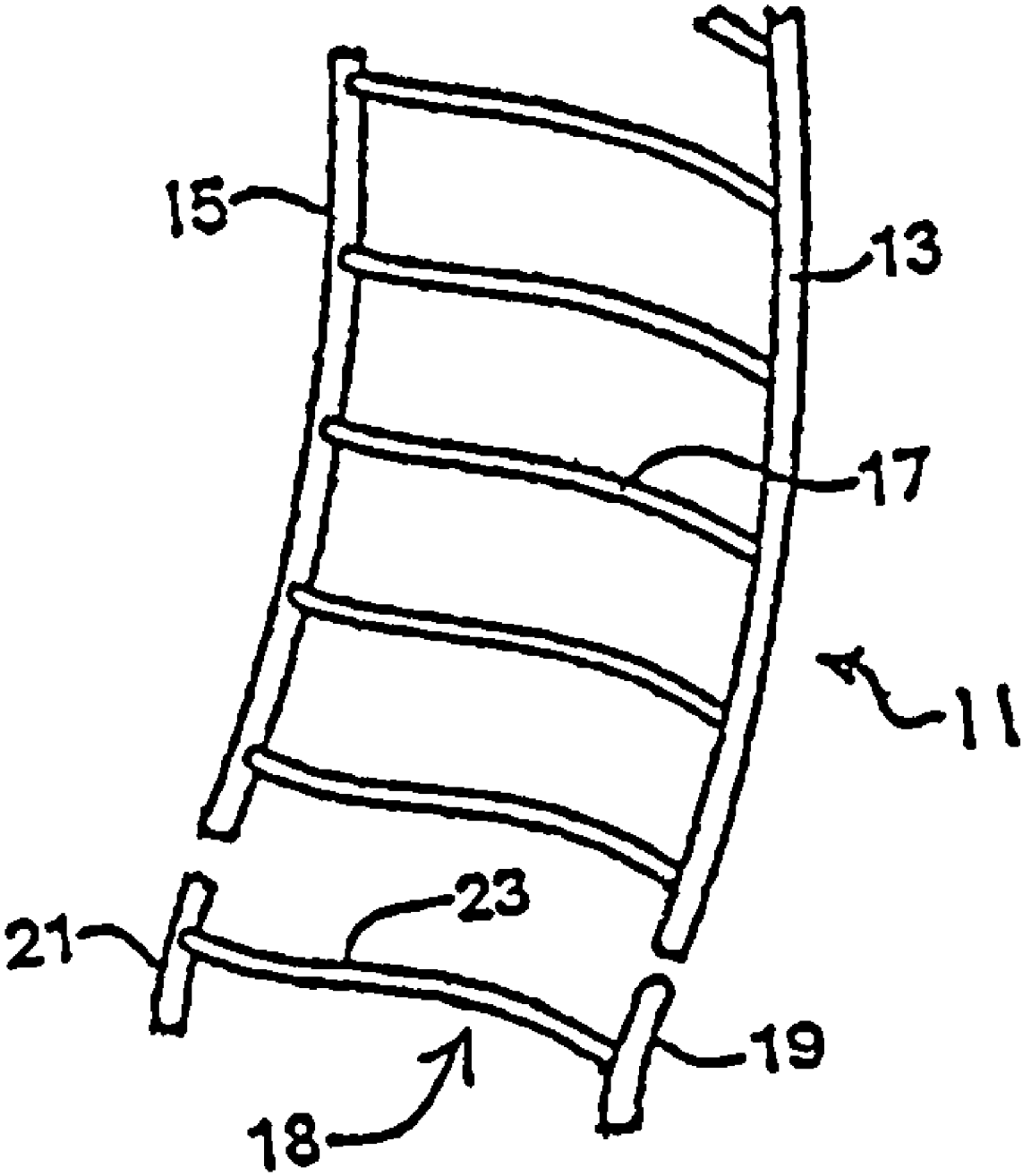
15
13
17
11
21
23
19
18

LOW MELT PLASTIC FASTENER

CROSS-REFERENCE TO RELATED APPLICATIONS

The present application claims the benefit under 35 U.S.C. 119(e) of U.S. Provisional Patent Application Ser. No. 60/998,870, filed on Oct. 12, 2007, the disclosure of which is incorporated herein by reference.

BACKGROUND OF THE INVENTION

The present invention relates generally to plastic fasteners.

In U.S. Pat. No. 4,039,078 to A. R. Bone, which is incorporated herein by reference, there are disclosed several different types of plastic fasteners (also commonly referred to in the art as plastic attachments). Each plastic fastener described in the patent is manufactured in an H-shaped configuration, with two shortened parallel cross-bars, or T-bars, being interconnected at their approximate midpoints by a thin, flexible filament which extends orthogonally therebetween. Each type of plastic fastener represented in the patent is shown as being fabricated as part of continuously connected ladder stock. In each instance, the ladder stock is formed from two elongated and continuous plastic side members, or rails, which are coupled together by a plurality of plastic cross-links, or filaments, the cross-links preferably being equidistantly spaced.

Continuously connected ladder stock may be made by various different methods. One such method comprises extruding a continuous strip of plastic and then punching out or forming apertures in the strip in such a way as to leave only the side members and the cross-links in the strip. Another method comprises injection molding two or more separate lengths of the fastener stock and then joining together the lengths by applying heat to weld the respective side members together. Neither of these two methods has received much, if any, commercial use in the manufacturing of continuously connected ladder stock.

Still another method for manufacturing continuously connected ladder stock is described in U.S. Pat. No. 4,462,784, inventor Russell, issued Jul. 31, 1984, which patent is incorporated herein by reference. According to this patent, continuously connected ladder stock is made by a rotary extrusion process that involves the use of a rotating molding wheel whose periphery is provided with molding cavities that are complementary in shape to the molded ladder stock. To form fasteners, plastic is extruded into the cavities of the molding wheel, and a knife in substantially elliptical contact with the wheel is used to skive excess plastic from the molding wheel, leaving plastic only in the molding cavities. Following molding, the filament portions of the fasteners are typically stretched.

After its manufacture, continuously connected ladder stock is commonly wound onto a reel, or spool, which is sized and shaped to hold a supply of ladder stock that includes approximately 25,000 fasteners. In this manner, the reel can be used by a machine to continuously dispense a large quantity of individual fasteners, as will be described in detail below. Either manually or with the aid of specifically designed devices, individual fasteners may be severed and dispensed from a supply of ladder stock to couple buttons to fabric, merchandising tags to articles of commerce, or, in general, any two desired articles. Ladder stock of the type described above is presently manufactured and sold by Avery Dennison Corporation of Pasadena, Calif. under the Plastic Staples and Elastic Staple™ lines of plastic fasteners.

Specifically designed devices for dispensing plastic fasteners are well known in the art. One well-known device for dispensing individual plastic fasteners from a reel of ladder-type fastener stock includes a pair of hollow needles which are adapted to penetrate through a particular item, a feed mechanism for advancing each rail of the supply of ladder stock into axial alignment behind the longitudinal bore defined by a corresponding hollow needle, a severing mechanism for severing a fastener to be dispensed through the pair of hollowed needles from the remainder of the ladder stock, and an ejection mechanism for ejecting the cross-bars of the severed fastener through the bores of the pair of hollowed needles and, in turn, through the particular item which is penetrated by the needles.

Continuously connected ladder stock of the type described above is commonly manufactured using a flexible plastic material, such as nylon, polypropylene, or polyurethane. Conventional ladder stock does not exhibit melting characteristics until exposed to temperatures greater than 210° C. For example, TEXIN® 255, a polyester-based thermoplastic polyurethane manufactured by Bayer MaterialScience LLC of Pittsburgh, Pa., is commonly used to manufacture ladder stock. It should be noted that TEXIN® 255 polyurethane begins to exhibit melting characteristics only when exposed to temperatures greater than 210° C.

SUMMARY OF THE INVENTION

It is an object of the present invention to provide a new plastic fastener.

It is another object of the present invention to provide a plastic fastener of the type described above that melts when heated to a temperature of about 130° C. to 180° C. for approximately 10 minutes.

It is still another object of the present invention to provide a plastic fastener of the type as described above which includes a limited number of parts, which is easy to use and which is inexpensive to manufacture.

Accordingly, there is provided a plastic fastener, the plastic fastener comprising: (a) a flexible filament, the flexible filament comprising a first end and a second end; and (b) a first enlargement, the first enlargement being disposed at the first end of the flexible filament; (c) wherein the flexible filament melts when heated to a temperature of about 130° C. to 180° C. for approximately 10 minutes.

The present invention is also directed at a length of continuously connected plastic ladder stock, the length of continuously connected plastic ladder stock comprising: (a) first and second continuous side members; and (b) a plurality of cross-links interconnecting said first and second continuous side members; (c) wherein the cross-links melt when heated to a temperature of about 130° C. to 118° C. for approximately 10 minutes.

Various other features and advantages will appear from the description to follow. In the description, reference is made to the accompanying drawing which forms a part thereof, and in which is shown by way of illustration, an embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

The accompanying drawing, which is hereby incorporated into and constitutes a part of this specification, illustrates an embodiment of the present invention and, together with the description, serves to explain the principles of the invention. In the drawing, wherein like reference numerals represent like parts:

FIG. 1 is a fragmentary, front perspective view of a length of continuously connected ladder stock constructed according to the teachings of the present invention, the ladder stock being shown with an individual fastener separated therefrom.

DETAILED DESCRIPTION OF PREFERRED EMBODIMENTS

Referring now to FIG. 1, there is shown a length of continuously connected fastener stock which is constructed according to the teachings of the present invention and identified generally by reference numeral 11. As will be described in detail below, fastener stock 11 is made from a material that melts when exposed to relatively low temperature heat (approximately 130° C. to 180° C.) for a limited period of time (approximately 10 minutes). For this reason, fastener stock 11 is referred to herein as "low melt fastener stock."

Low melt fastener stock 11 preferably comprises a pair of elongated and continuous side members, or rails, 13 and 15 which are interconnected by a plurality of equidistantly spaced cross-links 17. An individual plastic fastener 18 is obtained from fastener stock 11 by severing side members 13 and 15 at the approximate midpoint between successive cross-links 17. Fastener 18 comprises a pair of enlargements or cross-bars 19 and 21 which are interconnected by a thin, flexible filament 23, cross-bars 19 and 21 comprising sections of side members 13 and 15, respectively, and filament 23 comprising a cross-link 17.

It should be noted that, by severing side members 13 and 15 at the approximate midpoint between successive cross-links 17, fastener 18 is provided with an H-shaped configuration, wherein opposing ends of filament 23 bisect corresponding cross-bars 19 and 21. As can be appreciated, it is typically preferred that fastener 18 have an H-type configuration when used in its conventional application of coupling together two or more items (i.e., in a manner similar to a staple).

As noted briefly above, fastener stock 11 is designed to melt after being heated for approximately 10 minutes at approximately 130° C. to 180° C. By comparison, traditional supplies of fastener stock that are manufactured using TEXIN® 255 polyurethane begin to exhibit melting characteristics only when exposed to temperatures greater than 210° C.

As defined herein, use of the term "melt" denotes that filament 23 of fastener 18 either (1) deforms to the extent that it no longer remains intact or (2) reduces in tensile strength to less than approximately 25-30% of its original value (e.g., a fastener which has an original tensile strength of approximately 4.0 lbs is reduced to less than approximately 1.0 lbs of tensile strength).

Preferably, fastener stock 11 comprises a low melt polyurethane that endows fastener stock 11 with the melting characteristics described above. More preferably, fastener stock 11 is made from a blend of a low melt polyurethane of the aforementioned type and a styrene acrylonitrile (SAN). It should be noted that SAN, when combined with polyurethane, serves to both significantly harden (i.e., stiffen) the material and lower its surface friction. As a result, the resultant plastic material has been found to be less susceptible to both (i) sticking within an extrusion wheel when molded and (ii) jamming within the hollowed needle of a fastener dispensing machine (as compared to more traditional plastic blends).

Preferably, fastener stock 11 comprises about 60-100%, by weight, low melt polyurethane and 0-40%, by weight, SAN. More preferably, fastener stock 11 comprises about 60-99%, by weight, low melt polyurethane and 1-40%, by weight, SAN.

According to one embodiment, fastener stock 11 may be manufactured, for example, by rotary extrusion molding, using a formulation consisting of the following composition: (i) 96%, by weight, of PEARLCOAT® 126K, a polyester based thermoplastic polyurethane elastomer (Merquinsa, Barcelona, Spain) having the following physical properties: a density at 20° C. of 1.20 g/cm$^3$; a Shore hardness of 94 A; a tensile strength of 35 MPa; a modulus at 100% elongation of 13 MPa; a modulus at 300% elongation of 25 MPa; an elongation at break of 420%; an abrasion loss of 40 mm$^3$; a melting range (MFI=10) of 155-165° C.; a softening range (film 300 μm) of 150-160° C.; and a $T_g$ (DSC, 10° C./min) of −22° C.; and (ii) 4%, by weight, of LUSTRAN® SAN 31 resin, an injection molding grade of transparent styrene acrylonitrile thermoplastic (INEOS ABS (USA) Corporation, Addyston, Ohio) having the following physical properties: a density at 23° C. of 0.039 lb/in$^3$; a specific volume at 23° C. of 25.9 in$^3$/lb; a tensile modulus at 23° C./50% r.h. of 475,000 lb/in$^2$; a tensile stress at break at 23° C./50% r.h. of 10,500 lb/in$^2$; and a Vicat softening temperature of 230° F.

Fastener stock 11 made with the aforementioned formulation melts when heated for approximately 10 minutes at approximately 165° C.

According to another embodiment, fastener stock 11 may be manufactured, for example, by rotary extrusion molding, using a formulation consisting of the following composition: (i) 75%, by weight, of PEARLCOAT® 125K, a polyester based thermoplastic polyurethane elastomer (Merquinsa, Barcelona, Spain) having the following physical properties: a density at 20° C. of 1.20 g/cm$^3$; a Shore hardness of 85 A; a tensile strength of 30 MPa; a modulus at 100% elongation of 6 MPa; a modulus at 300% elongation of 9 MPa; an elongation at break of 500%; an abrasion loss of 25 mm$^3$; a melting range (MFI=10) of 135-145° C.; a softening range (film 300 μm) of 125-135° C.; and a $T_g$ (DSC, 10° C./min) of −27° C.; and (ii) 25%, by weight, of LUSTRAN® SAN 31.

Fastener stock 11 made with the foregoing formulation melts when heated for approximately 10 minutes at approximately 155° C.

According to yet another embodiment, fastener stock 11 may be manufactured, for example, by rotary extrusion molding, using a formulation comprising LUSTRAN® SAN 31 and PEARLBOND® 122, a linear, polycaprolactone-based polyurethane (Merquinsa, Barcelona, Spain) having the following physical properties: a density at 20° C. of 1.19 g/cm$^3$; a Shore hardness of 54 D; a melt flow index (170° C./21.6 Kg) of 90-145 g/10 min; a melt flow index (160° C./2.16 Kg) of 5 g/10 min; a melt viscosity (160° C./2.16 Kg) of 2,200 Pa·s; a softening range of 63-67° C.; a melting temperature range of 67-71° C.; a very high thermoplasticity; an extremely high crystallization rate; and a Viscosity Brookfield RVT (15% in MEK) of 250-500 Pa·s.

Fastener stock 11 made with the above combination of LUSTRAN® SAN 31 and PEARLBOND® 122 will melt when heated at temperatures below 155° C. since PEARLBOND® 122 polyurethane has a lower melting temperature range (67-71° C.) than the melting temperature range for PEARLCOAT® 125K (135-145° C.).

It should be understood that the composition of fastener stock 11 could be modified further without significantly altering its melting characteristics, for example, by using other types of low melt polyurethanes. It is to be understood that all such modifications are encompassed within the spirit of the present invention.

It should also be understood that the percentage of styrene acrylonitrile (SAN) in each of the above compositions could be increased or decreased without significantly altering the melting characteristics of the resultant fastener stock. Accordingly, it is to be understood that the percentage of the SAN additive could be varied in each of the above-described compositions without departing from the spirit of the present invention.

One useful application for low melt fastener 18 is in the manufacture of plywood (as well as veneer). Specifically, as part of the process of manufacturing plywood, a plurality of thin layers of wood are cut (i.e., sliced or skived) from a source (e.g., a log), each layer being in the form of an irregular sheet that is approximately 0.125 inches thick. Each of the thin layers of wood typically retains a considerable amount of moisture and, as such, requires substantial drying.

Accordingly, it is well known in the art for the thin layers of wet wood to be disposed on a conveyor belt which, in turn, feeds the layers of wood through a drying oven which operates at approximately 170° C., the conveyor belt operating at a speed which exposes each layer of wood to approximately 10 minutes of drying within the oven. As the layers exit the oven, each layer is tested for moisture. The layers which have sufficiently dried are then treated with an adhesive and are affixed to one another in a stacked relationship to form a single piece of plywood (which may be then cut in a particular size and/or shape). To the contrary, the layers which have insufficiently dried are subjected to the above-described drying process once again.

It is preferred that the multiple layers of wet wood be connected together prior to their placement on the conveyor belt to facilitate handling and optimize spacing within the drying oven (i.e., maximize the number of layers that can be dried at one time). For this reason, it is well known in the art for multiple layers of wet wood to be disposed end-to-end and joined together at their juncture using tape.

Once sufficiently dried, the layers of wood require separation from one another so that the plywood manufacturing process can be completed. Accordingly, in the art, a laborer is typically required to sever the tape that was previously used to join separate sheets of wood. As can be appreciated, the application and removal of tape to and from sheets of wood has been found to be a tedious and time-consuming process.

Accordingly, it is anticipated that low melt fastener 18 (preferably with a filament length of 19 mm) be used to connect multiple layers of wet wood prior to placement on the drying oven conveyor belt. Specifically, using a fastener dispensing tool (e.g., the ST9000™ or Elastic Staple™ Variable Needle System (VNS) fastener dispensing tool manufactured and sold by Avery Dennison Corporation of Pasadena, Calif.), cross-bars 19 and 21 are driven through a pair of wood pieces (with thin filament 23 keeping the pieces connected). After approximately 10 minutes of exposure to heat within the drying oven, filament 23 sufficiently melts to the extent necessary that the pair of wood layers can be easily separated when removed from the conveyor belt, which is highly desirable.

It should be understood that low melt fastener 18 need not be limited to the wood drying application described in detail above. Rather, it is to be understood that low melt fastener 18 could be utilized in alternative applications without departing from the spirit of the present invention.

It should also be understood that the low melt fastener of the present invention is not limited to fasteners of the type obtained from continuously connected ladder stock and may include, for example, a plastic fastener from a clip-type assembly of the type disclosed in U.S. Pat. No. 3,103,666, inventor Bone, issued Sep. 17, 1963, which patent is incorporated herein by reference.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A plastic fastener comprising:

(a) a flexible filament, the flexible filament comprising a first end and a second end;

(b) a first enlargement, the first enlargement being disposed at the first end of the flexible filament; and (c) a second enlargement, the second enlargement being disposed at the second end of the flexible filament;

(d) wherein the flexible filament melts when heated to a temperature of about 130° C. to 180° C. for approximately 10 minutes and wherein the flexible filament comprises a polyurethane having a melting temperature of approximately 130° C.-180° C.

2. The plastic fastener as claimed in claim 1 wherein the first enlargement is a cross-bar.

3. The plastic fastener as claimed in claim 1 wherein the second enlargement is a cross-bar.

4. The plastic fastener as claimed in claim 1 wherein the flexible filament further comprises a styrene acrylonitrile.

5. The plastic fastener as claimed in claim 1 wherein the flexible filament comprises about 60-100%, by weight, of a polyurethane and 0-40%, by weight, of a styrene acrylonitrile.

6. The plastic fastener as claimed in claim 1 wherein the flexible filament comprises about 60-99%, by weight, of a polyurethane and 1-40%, by weight, of a styrene acrylonitrile.

7. The plastic fastener as claimed in claim 1 wherein the flexible filament, the first enlargement and the second enlargement are made of the same material and form a unitary structure.

8. The plastic fastener as claimed in claim 1 wherein the flexible filament melts when heated to a temperature of not greater than about 165° C. for approximately 10 minutes.

9. The plastic fastener as claimed in claim 1 wherein the polyurethane has a melting temperature in the range of 155° C.-165° C.

10. The plastic fastener as claimed in claim 1 wherein the polyurethane has a melting temperature in the range of 135° C.-145° C.

11. A plastic fastener comprising:

(a) a flexible filament, the flexible filament comprising a first end and a second end; and (b) a first enlargement, the first enlargement being disposed at the first end of the flexible filament;

(c) wherein the flexible filament melts when heated to a temperature of about 130° C. to 180° C. for approximately 10 minutes and wherein the flexible filament consists of (i) about 96%, by weight, of a polyester-based thermoplastic polyurethane elastomer having a density at 20° C. of 1.20 g/cm$^3$; a Shore hardness of 94 A; a tensile strength of 35 MPa; a modulus at 100% elongation of 13 MPa; a modulus at 300% elongation of 25 MPa; an elongation at break of 420%; an abrasion loss of 40 mm$^3$; a melting range (MFI=10) of 155-165°

C.; a softening range (film 300 μm) of 150-160° C.; and a $T_g$ (DSC, 10° C./min) of −22° C.; and (ii) about 4%, by weight, of an injection molding grade of a transparent styrene acrylonitrile resin having a density at 23° C. of 0.039 lb/in$^3$; a specific volume at 23° C. of 25.9 in$^3$/lb; a tensile modulus at 23° C./50% r.h, of 475,000 lb/in$^2$; a tensile stress at break at 23° C./50% r.h, of 10,500 lb/in$^2$; and a Vicat softening temperature of 230° F.

12. A plastic fastener comprising:

(a) a flexible filament, the flexible filament comprising a first end and a second end; and (b) a first enlargement, the first enlargement being disposed at the first end of the flexible filament;

(c) wherein the flexible filament melts when heated to a temperature of about 130° C. to 180° C. for approximately 10 minutes and wherein the flexible filament consists of (i) about 75%, by weight, of a polyester based thermoplastic polyurethane elastomer having a density at 20° C. of 1.20 g/cm$^3$; a Shore hardness of 85 A; a tensile strength of 30 MPa; a modulus at 100% elongation of 6 MPa; a modulus at 300% elongation of 9 MPa; an elongation at break of 500%; an abrasion loss of 25 mm$^3$; a melting range (MFI=10) of 135-145° C.; a softening range (film 300 μm) of 125-135° C.; and a $T_g$ (DSC, 10° C./min) of −27° C.; and (ii) about 25%, by weight, of an injection molding grade of a transparent styrene acrylonitrile resin having a density at 23° C. of 0.039 lb/in$^3$; a specific volume at 23° C. of 25.9 in$^3$/lb; a tensile modulus at 23° C./50% r.h, of 475,000 lb/in$^2$; a tensile stress at break at 23° C./50% r.h, of 10,500 lb/in$^2$; and a Vicat softening temperature of 230° F.

13. A length of continuously connected plastic ladder stock comprising:

(a) first and second continuous side members; and (b) a plurality of cross-links interconnecting said first and second continuous side members;

(c) wherein the cross-links melt when heated to a temperature of about 130° C. to 180° C. for approximately 10 minutes and wherein each of the cross-links comprises a polyurethane and a styrene acrylonitrile.

14. The length of continuously connected plastic ladder stock as claimed in claim 13 wherein each of the cross-links comprises about 60-100%, by weight, of a polyurethane and up to 40%, by weight, of a styrene acrylonitrile.

15. The length of continuously connected plastic ladder stock as claimed in claim 13 wherein each of the cross-links comprises about 60-99%, by weight, of a polyurethane and 1-40%, by weight, of a styrene acrylonitrile.

16. The length of continuously connected plastic ladder stock as claimed in claim 13 wherein each of the cross-links consists of (i) about 96%, by weight, of a polyester-based thermoplastic polyurethane elastomer having a density at 20° C. of 1.20 g/cm$^3$; a Shore hardness of 94 A; a tensile strength of 35 MPa; a modulus at 100% elongation of 13 MPa; a modulus at 300% elongation of 25 MPa; an elongation at break of 420%; an abrasion loss of 40 mm$^3$; a melting range (MFI=10) of 155-165° C.; a softening range (film 300 μm) of 150-160° C.; and a $T_g$ (DSC, 10° C./min) of −22° C.; and (ii) about 4%, by weight, of an injection molding grade of a transparent styrene acrylonitrile resin having a density at 23° C. of 0.039 lb/in$^3$; a specific volume at 23° C. of 25.9 in$^3$/lb; a tensile modulus at 23° C./50% r.h, of 475,000 lb/in$^2$; a tensile stress at break at 23° C./50% r.h, of 10,500 lb/in$^2$; and a Vicat softening temperature of 230° F.

17. The length of continuously connected plastic ladder stock as claimed in claim 13 wherein each of the cross-links consists of (i) about 75%, by weight, of a polyester based thermoplastic polyurethane elastomer having a density at 20° C. of 1.20 g/cm$^3$; a Shore hardness of 85 A; a tensile strength of 30 MPa; a modulus at 100% elongation of 6 MPa; a modulus at 300% elongation of 9 MPa; an elongation at break of 500%; an abrasion loss of 25 mm$^3$; a melting range (MFI=10) of 135-145° C.; a softening range (film 300 μm) of 125-135° C.; and a $T_g$ (DSC, 10° C./min) of −27° C.; and (ii) about 25%, by weight, of an injection molding grade of a transparent styrene acrylonitrile resin having a density at 23° C. of 0.039 lb/in$^3$; a specific volume at 23° C. of 25.9 in$^3$/lb; a tensile modulus at 23° C./50% r.h, of 475,000 lb/in$^2$; a tensile stress at break at 23° C./50% r.h, of 10,500 lb/in$^2$; and a Vicat softening temperature of 230° F.

18. The length of continuously connected plastic ladder stock as claimed in claim 13 wherein the first and second continuous side members and the plurality of cross-links are made of the same material and form a unitary structure.

19. The length of continuously connected plastic ladder stock as claimed in claim 13 wherein the cross-links melt when heated to a temperature of not greater than about 165° C. for approximately 10 minutes.

20. The length of continuously connected plastic ladder stock as claimed in claim 13 wherein the cross-links comprise a polyurethane having a melting temperature of approximately 130° C.-180° C.

21. The length of continuously connected plastic ladder stock as claimed in claim 20 wherein the polyurethane has a melting temperature in the range of 155° C.-165° C.

22. The length of continuously connected plastic ladder stock as claimed in claim 20 wherein the polyurethane has a melting temperature in the range of 135° C.-145° C.

* * * * *